US008424794B2

(12) United States Patent
Wang

(10) Patent No.: US 8,424,794 B2
(45) Date of Patent: Apr. 23, 2013

(54) MAGNETIC FIXING DEVICE FOR FIXING MAGNETIC COIL TO ROTOR OF AUTOWINDER AND APPARATUS FOR WINDING COIL ON MAGNETIC COIL

(75) Inventor: Yu-Bin Wang, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 1142 days.

(21) Appl. No.: 12/342,219

(22) Filed: Dec. 23, 2008

(65) Prior Publication Data

US 2009/0289140 A1 Nov. 26, 2009

(30) Foreign Application Priority Data

May 22, 2008 (CN) ..... 2008 1 0301721

(51) Int. Cl.
*B21C 47/02* (2006.01)

(52) U.S. Cl.
USPC ..... 242/448; 242/437; 242/437.3

(58) Field of Classification Search ..... 242/431, 242/437, 437.3, 448
See application file for complete search history.

(56) References Cited

U.S. PATENT DOCUMENTS

| | | | | |
|---|---|---|---|---|
| 1,833,221 | A * | 11/1931 | Leidy | 29/605 |
| 4,097,987 | A * | 7/1978 | Miller | 29/605 |
| 4,538,771 | A * | 9/1985 | Tardy | 242/431 |
| 4,833,774 | A * | 5/1989 | Jacob-Grinschgl et al. | 29/605 |
| 6,644,584 | B2 * | 11/2003 | Mori et al. | 242/437.3 |
| 7,082,674 | B2 * | 8/2006 | Mori et al. | 29/605 |
| 2003/0160126 | A1 * | 8/2003 | Mori et al. | 242/445.1 |
| 2011/0163196 | A1 * | 7/2011 | Wang | 242/448 |

FOREIGN PATENT DOCUMENTS

| | | |
|---|---|---|
| CN | 2105750 U | 5/1992 |

* cited by examiner

*Primary Examiner* — Emmanuel M Marcelo
(74) *Attorney, Agent, or Firm* — Altis Law Group, Inc.

(57) ABSTRACT

A magnetic fixing device for fixing a magnetic coil to a rotor of an autowinder includes a first clip element and a second element. The first clip element is disposed on the rotor of the autowinder, and the second clip element corresponds to the first clip element for cooperatively clipping the magnetic coil by magnetic force.

20 Claims, 4 Drawing Sheets

MAGNETIC FIXING DEVICE FOR FIXING MAGNETIC COIL TO ROTOR OF AUTOWINDER AND APPARATUS FOR WINDING COIL ON MAGNETIC COIL

BACKGROUND

1. Technical Field

The invention relates to magnetic coil winding, and more particularly to a magnetic coil fixing device.

2. Description of Related Art

Electromagnetic devices such as transformers and relays often utilize a magnetic coil with winding therearound. During assembly, the magnetic coil is fixed to a rotor of a winding machine by a fixing element such as screw nut and screw shaft, and a wire is rotated by the rotor of the winding machine to be disposed around the magnetic coil. After the wire becomes the winding, the screw nut and screw shaft are relaxed for taking the magnetic coil out from the rotor of the winding machine.

However, during the assembly process, the magnetic coil wastes time for fixing or taking out from the rotor of the winding machine and decreases the producible efficiency.

DETAILED DESCRIPTION

Figure 1:
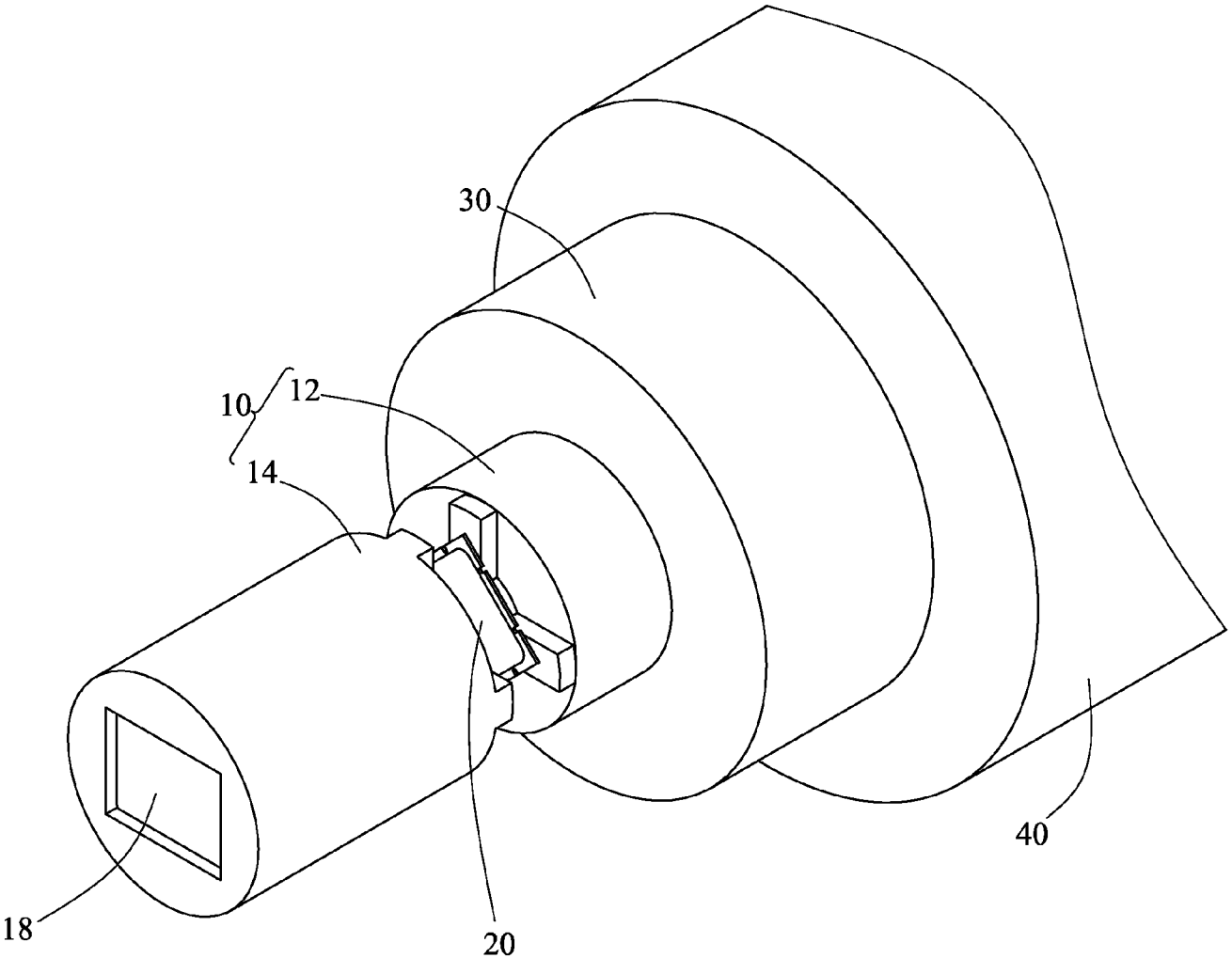
FIG. 1 is an isometric assembly view of a magnetic coil fixing device showing a magnetic coil is fixed to a rotor of an autowinder by the magnetic coil fixing device, in accordance with an embodiment.

Referring to FIG. 1, in accordance with a magnetic coil fixing device 10 of an embodiment. The magnetic coil fixing device 10 fixes a magnetic coil 20 on a rotor 30 of an autowinder 40 for rotating the magnetic coil 20 to be winded. The magnetic coil fixing device 10 includes a first clip element 12, a second clip element 14, and a permanent magnet 18. In this embodiment, the magnetic coil fixing device 10 is a single structure or belongs to a part of the autowinder 40, for example, the magnetic coil fixing device 10 is a single structure and connects with the autowinder 40.

Figure 2:
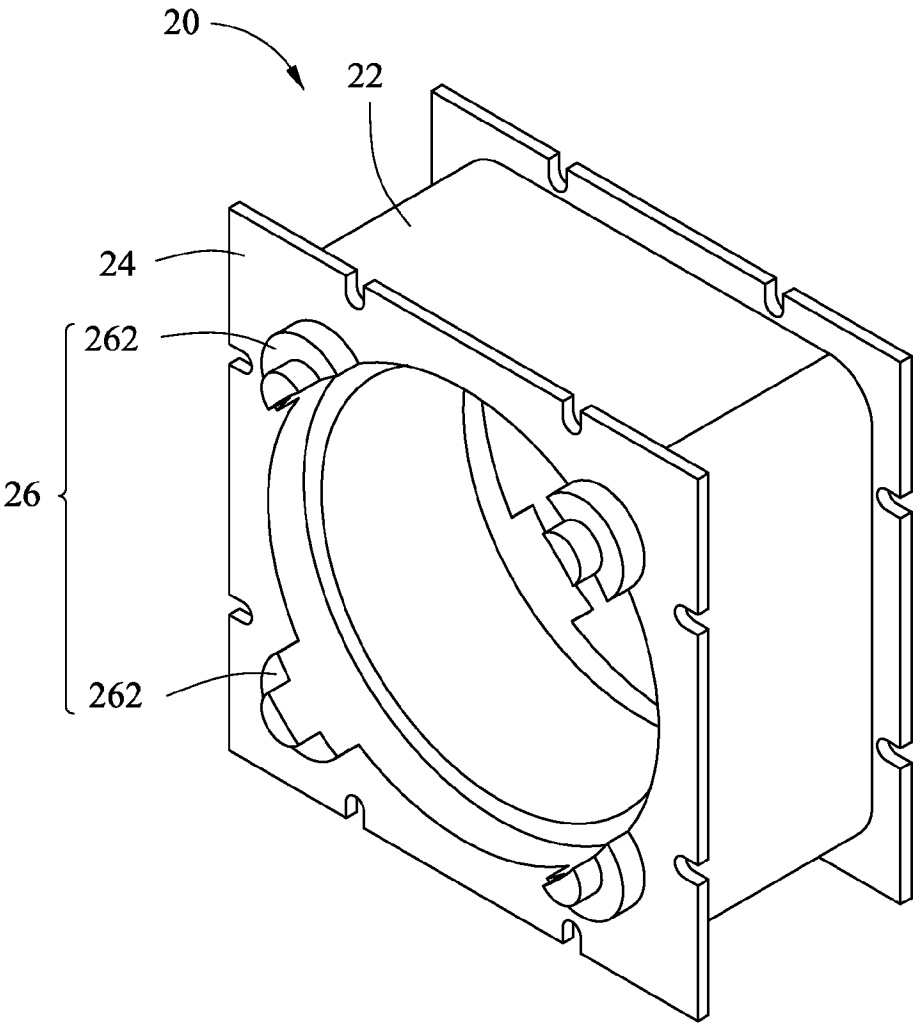
FIG. 2 is an isometric magnified view of the magnetic coil of FIG. 1.

In addition, referring to FIG. 2, the magnetic coil 20 generally includes a winding portion 22 and two first fixed structures 26. The winding portion 22 is tube-shaped, and two ends of the winding portion 22 define a contact face 24 which is rectangle shaped. The first fixed structures 26 are disposed on the contact faces 24, respectively. The first fixed structure 26 includes a fixed pillar 262, and numbers of the fixed pillars 262 aren't limited, for example, each the first fixed structure 26 includes four the fixed pillars 262.

Figure 3:
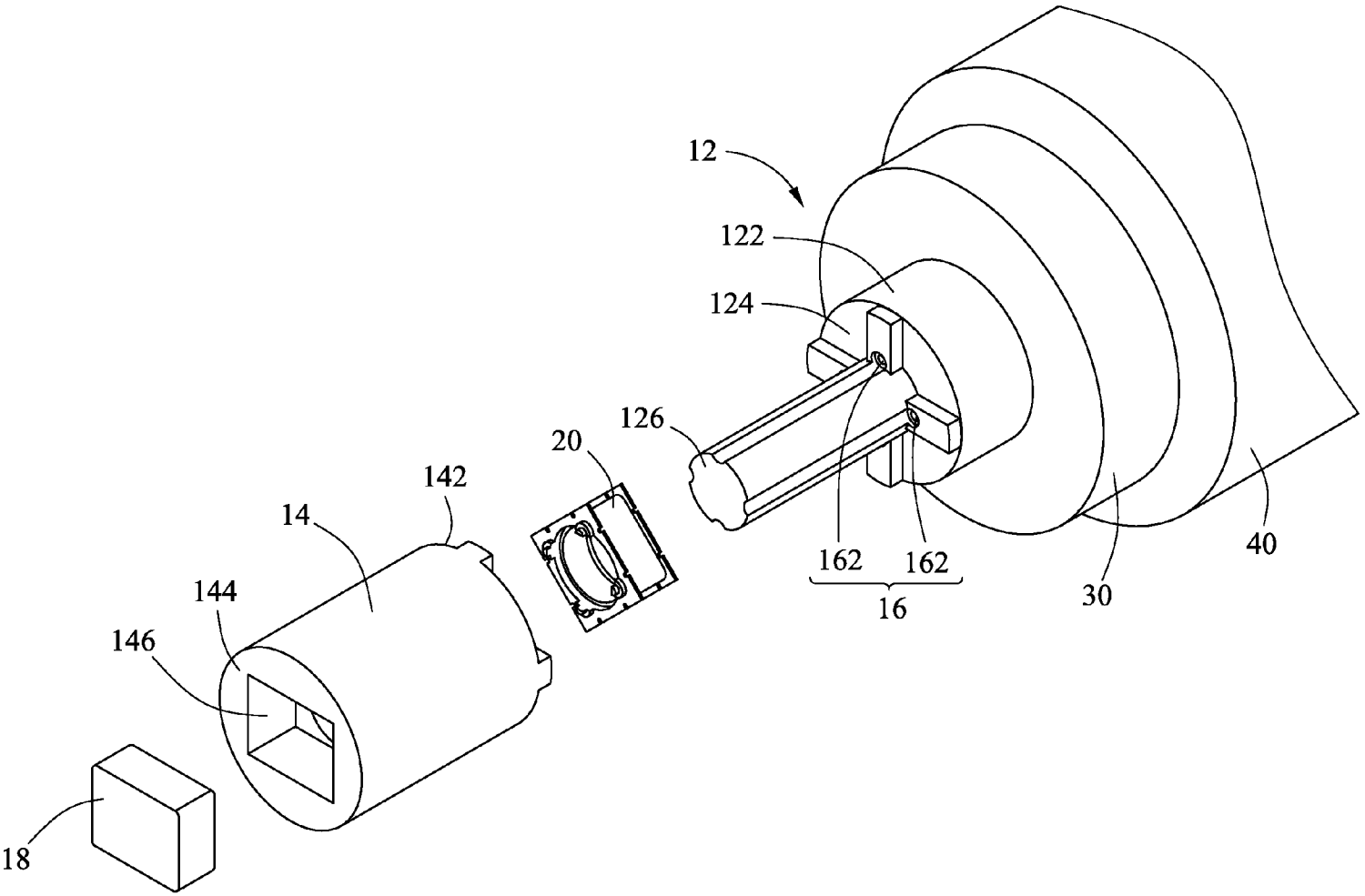
FIG. 3 is an exploded, isometric view of the magnetic coil fixing device of FIG. 1 showing the magnetic coil and the rotor of the autowinder.

Referring to FIG. 3, the first clip element 12 includes a cylinder 122, one end of which is fixed on the rotor 30 of the autowinder 40, and the other defines a first clip face 124. In addition, the first clip element 12 further includes a fixed support axle 126 which extends from the first clip face 124 and extends through the magnetic coil 20. The first clip face 124 includes a second fixed structure 16 which cooperates with the first fixed structures 26 and includes a fixed recess 162. The fixed recess 162 is disposed on the first clip face 124, with the number of fixed recesses 162 not limited, for example, each second fixed structure 16 can include four fixed recesses 162.

Figure 4:
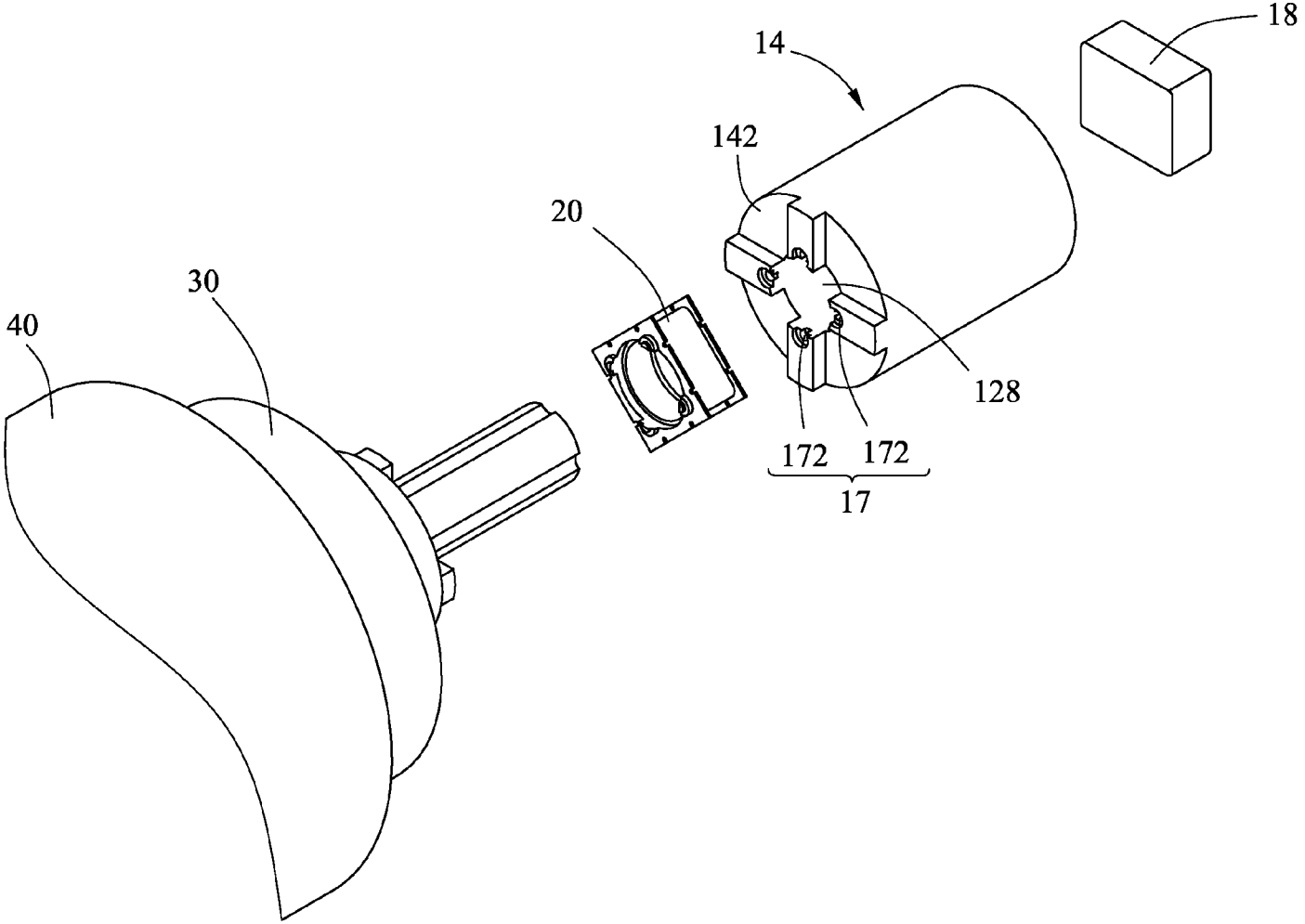
FIG. 4 s a different side, exploded, isometric view of the magnetic coil fixing device of FIG. 1 showing the magnetic coil and the rotor of the autowinder.

One end of the second clip element 14 defines a second clip face 142 corresponding to the first clip face 124, and the other end of the second clip element 14 defines a receiving space 146. The second clip element 14 is cylindrical. Referring to FIG. 4, in addition, the second clip face 142 also includes a second fixed structure 17 cooperative with the first fixed structures 26. The second fixed structure 17 includes a fixed recess 172 disposed on the second clip face 142. The number of fixed recesses 172 is not limited, for example, each second fixed structure 17 can include four fixed recesses 172. The second clip element 14 defines a fixed hole 128 which cooperates with the fixed support axle 126. Furthermore, the permanent magnet 18 is received in the receiving space 146.

In this embodiment, the first clip face 124 and the second clip face 142 are larger than the contact face 24 to securely clip magnetic coil 20. The first clip element 12 and the second clip element 14 are symmetric about the axle and in-line on the rotor of the autowinder to avoid deflective force. First clip element 12 and second clip element 14 can be varied in material, for example, the first clip element 12 can be ferromagnetic material and the second clip element 14 permanent magnetic material, or second clip element 14 can be ferromagnetic material and first clip element 12 permanent magnet material, or both of permanent magnet material.

Referring also to FIG. 2 and FIG. 3, when assembled on the autowinder 40, the magnetic coil 20 is disposed between the first clip element 12 and the second clip element 14. The winding portion 22 of magnetic coil 20 surrounds the fixed support axle 126, and the second clip element 14 surrounds the fixed support axle 126. The fixed support axle 126 is insertable in the second clip element 14. At this time, the first clip element 12 and the permanent magnet 18 is received in the receiving space 146 generate a magnetic force to compel the second clip element 14, fixing the magnetic coil 20 to the first clip element 12.

Furthermore, the four fixed pillars 262 of the first fixed structure 26 of the magnetic coil 20 enter the four fixed recesses 162 of the second fixed structure 16 of the first clip element 12, respectively. Similarly, the four fixed pillars 262 of the first fixed structure 26 of the magnetic coil 20 enter the fixed recesses 172 of the second fixed structure 17 of the second clip element 14, respectively. In this way, the first clip element 12, the magnetic coil 20 and the second clip element 14 all avoid rotating opposite to each other. The magnetic coil 20 can be fixed on the autowinder 40, as shown in FIG. 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A magnetic fixing device for fixing a magnetic coil to a rotor of an autowinder, the magnetic fixing device comprising:

a first clip element for mounting on the rotor of the autowinder; and a second clip element configured for magnetically attaching to the first clip element, whereby the magnetic coil can be fixedly sandwiched between the first and second clip elements.

2. The magnetic fixing device as claimed in claim 1, wherein the first clip element includes an axle for extending through the magnetic coil.

3. The magnetic fixing device as claimed in claim 2, wherein the axle is insertable in the second clip element.

4. The magnetic fixing device as claimed in claim 2, wherein the first clip element comprises a cylinder, one end of the cylinder is configured for fixing on the rotor of the autowinder and the other end of the cylinder defines a first clip face, and one end of the second clip element defines a second clip face facing the first clip face.

5. The magnetic fixing device as claimed in claim 4, wherein the axle extends from the first clip face of the first clip element.

6. The magnetic fixing device as claimed in claim 5, wherein a fixed hole is defined in the second clip element, and the fixed hole is configured for receiving the axle of the first clip element.

7. The magnetic fixing device as claimed in claim 1, further comprising: a permanent magnet received in a receiving space defined in the second clip element.

8. The magnetic fixing device as claimed in claim 1, wherein the magnetic coil comprises a winding portion, and the winding portion is tube-shaped in order that the axle is capable of extending through the magnetic coil.

9. The magnetic fixing device as claimed in claim 8, wherein the winding portion comprises a first contact face and a second contact face, at least one first fixed pillar is disposed on the first contact face, and at least one second fixed pillar is disposed on the second contact face.

10. The magnetic fixing device as claimed in claim 9, wherein the first clip element further comprises at least one first fixed recess formed at the first clip face and configured for receiving the at least one first fixed pillar, and the second clip element further comprises at least one second fixed recess formed at the second clip face and configured for receiving the at least one second fixed pillar.

11. The magnetic fixing device as claimed in claim 1, wherein one of the first clip element and the second clip element has permanent magnetic material, and the other one of the first clip element and the second clip element has material selected from permanent magnetic material and ferromagnetic material, such that the first clip element and the second clip element magnetically attach to each other.

12. An apparatus for winding a coil on a magnetic coil, the apparatus comprising:

a rotor;

a first clip element mounted on the rotor; and a second clip element configured for magnetically attaching to the first clip element, whereby the magnetic coil can be fixedly sandwiched between the first and second clip elements.

13. The apparatus as claimed in claim 12, wherein the first clip element includes an axle for extending through the magnetic coil.

14. The apparatus as claimed in claim 13, wherein the axle is insertable in the second clip element.

15. The apparatus as claimed in claim 13, wherein the first clip element comprises a cylinder, one end of the cylinder is configured for fixing on the rotor of the apparatus and the other end of the cylinder defines a first clip face, and one end of the second clip element defines a second clip face facing the first clip face.

16. The apparatus as claimed in claim 15, wherein the axle extends from the first clip face of the first clip element.

17. The apparatus as claimed in claim 16, wherein a fixed hole is defined in the second clip element, and the fixed hole is configured for receiving the axle of the first clip element.

18. The apparatus as claimed in claim 12, further comprising: a permanent magnet received in a receiving space defined in the second clip element.

19. The apparatus as claimed in claim 12, wherein the magnetic coil comprises a winding portion, and the winding portion is tube-shaped in order that the axle is capable of extending through the magnetic coil.

20. The apparatus as claimed in claim 12, wherein one of the first clip element and the second clip element has permanent magnetic material, and the other one of the first clip element and the second clip element has material selected from permanent magnetic material and ferromagnetic material, such that the first clip element and the second clip element magnetically attach to each other.

* * * * *